US010550632B2

(12) United States Patent
Lemiegre et al.

(10) Patent No.: US 10,550,632 B2
(45) Date of Patent: Feb. 4, 2020

(54) SLAT ROOF AND METHOD FOR ADAPTING A SLAT ROOF

(71) Applicant: RENSON SUNPROTECTION-SCREENS NV, Waregem (BE)

(72) Inventors: Kristof Lemiegre, Waregem (BE); Thierry Veys, Waregem (BE); Bart Abeel, Waregem (BE)

(73) Assignee: RENSON SUNPROTECTION-SCREENS NV, Waregem (BE)

( * ) Notice: Subject to any disclaimer, the term of this patent is extended or adjusted under 35 U.S.C. 154(b) by 0 days.

(21) Appl. No.: 15/577,760

(22) PCT Filed: May 23, 2016

(86) PCT No.: PCT/IB2016/053011
§ 371 (c)(1),
(2) Date: Nov. 28, 2017

(87) PCT Pub. No.: WO2016/189449
PCT Pub. Date: Dec. 1, 2016

(65) Prior Publication Data

US 2018/0128040 A1 May 10, 2018

(30) Foreign Application Priority Data

May 28, 2015 (BE) ..... 2015/5333

(51) Int. Cl.
*E04B 1/346* (2006.01)
*E06B 7/096* (2006.01)
(Continued)

(52) U.S. Cl.
CPC ..... *E06B 7/096* (2013.01); *E04B 7/166* (2013.01); *E04F 10/10* (2013.01); *E06B 9/0638* (2013.01); *E06B 7/082* (2013.01)

(58) Field of Classification Search
CPC ..... E06B 7/096; E06B 9/0638; E06B 7/084; E06B 7/082; E04B 7/166; E04F 10/10
(Continued)

(56) References Cited

U.S. PATENT DOCUMENTS 2,967,567 A * 1/1961 Heckerman ..... E04F 10/10 160/172 R
4,128,307 A * 12/1978 Badertscher ..... A01G 9/222 359/596

(Continued)

FOREIGN PATENT DOCUMENTS

EP 2431547 A1 3/2012

OTHER PUBLICATIONS

International Search Report dated Sep. 2, 2017.

*Primary Examiner* — Basil S Katcheves
(74) *Attorney, Agent, or Firm* — Symbus Law Group, LLC; Clifford D. Hyra

(57) ABSTRACT

A slat roof (1) comprising beams (2), a plurality of slats (3) arranged parallel to one another therebetween and slat shafts (4) by means of which the slats (3) are rotatably fixed to the respective beams (2), wherein at least one slat shaft (4) is hollow and wherein the slat roof (1) comprises at least one corresponding tensioning cable (5) which is inserted through said hollow slat shaft (4) and the ends of which are fixed to the respective beams (2). In addition, a method for adapting a slat roof.

14 Claims, 6 Drawing Sheets

(51) Int. Cl.

| | |
|---|---|
| ***E04F 10/10*** | (2006.01) |
| ***E04B 7/16*** | (2006.01) |
| ***E06B 9/06*** | (2006.01) |
| *E06B 7/082* | (2006.01) |

(58) Field of Classification Search
USPC ..... 52/64
See application file for complete search history.

(56) References Cited

U.S. PATENT DOCUMENTS

| | | | | | |
|---|---|---|---|---|---|
| 4,427,048 | A * | 1/1984 | Osaka | E06B 9/264 | 160/107 |
| 4,462,452 | A * | 7/1984 | Oskam | A01G 9/222 | 160/176.1 R |
| 4,984,399 | A * | 1/1991 | Taylor | E04H 6/04 | 160/113 |
| 5,584,331 | A * | 12/1996 | Lin | E06B 7/086 | 160/172 R |
| 6,568,131 | B1 * | 5/2003 | Milano, Jr. | E06B 7/096 | 49/25 |
| 8,136,306 | B2 * | 3/2012 | Scheps | E04B 1/34305 | 52/64 |
| 8,468,751 | B2 * | 6/2013 | Williams | E04B 2/827 | 160/201 |
| 2008/0190043 | A1 * | 8/2008 | Beckmann | A47H 21/00 | 52/64 |
| 2012/0279140 | A1 * | 11/2012 | Silberman | E04F 10/02 | 52/64 |
| 2013/0192770 | A1 * | 8/2013 | Murphy, Jr. | E04F 10/10 | 160/5 |
| 2018/0022400 | A1 * | 1/2018 | Adams | B65G 67/20 | 52/64 |
| 2018/0126833 | A1 * | 5/2018 | Hannan | B60J 7/068 | |

* cited by examiner

SLAT ROOF AND METHOD FOR ADAPTING A SLAT ROOF

This application claims the benefit of Belgian patent application No. BE2015/5333, filed May 28, 2015, which is hereby incorporated by reference in its entirety.

FIELD OF THE DISCLOSURE

Embodiments of the present invention relate to a slat roof comprising beams, a plurality of slats arranged parallel to one another therebetween and slat shafts by means of which the slats are rotatably fixed to the respective beams.

Embodiments of the present invention further relate to a method for adapting a slat roof into a slat roof according to the present invention.

BACKGROUND

Slat roofs having rotatable slats are usually used to cover an outdoor area, such as a terrace covering or veranda roof, etc. In addition to said slats, a slat roof of this type may also comprise one or more additional slats. Using such a rotatably arranged slat shaft, the slats are rotatable between an open position, in which an intermediate space extends between the slats, and a closed position, in which the slats together form a closed shelter. By rotating the slats between these positions, it is possible to regulate the incidence of light, the radiant heat and the ventilation into the space underneath the slats. By directing the slats, it is possible to protect against the sun and/or wind or, on the contrary, to let them in.

In addition, the slats may optionally be provided slideably in the slat roof, with, in that case, the slats being typically slideable between a position in which they are spread out over the slat roof and a position in which they are substantially arranged at one side of the slat roof.

A problem with such slat roofs is that the beams begin to bulge under the weight and the bending of the slats suspended between them in the plane of these slats. Given the growing trend of designing larger uninterrupted covers to have such slat roofs and of using heavier slats in such covers, such as glass slats, for example, this is an ever increasing problem.

In order to remedy this problem, the beams are often designed to be sturdier. However, this requires more material and means that the beams become a great deal more expensive, which also results in a considerable increase in the cost price of the entire slat roof. Wider and heavier beams are often also undesirable for aesthetic reasons.

It is also known to place the beams at an incline, counter to the bulging, so that they return to being upright as a result of the bulging. However, it is difficult to connect such beams to other girders which in this case together form a frame for the slat roof. Such beams are difficult to mitre in an aesthetic manner.

It is further known to provide a transverse girder in the centre of such a slat roof. However, most customers do not wish for such a division of their slat roof using such a transverse girder.

SUMMARY

An object of the present invention is to provide an economically and aesthetically favourable solution to the stated problem.

This object may be achieved by providing a slat roof comprising beams, a plurality of slats arranged parallel to one another therebetween and slat shafts by means of which the slats are rotatably fixed to the respective beams, wherein at least one slat shaft is hollow and wherein the slat roof comprises at least one corresponding tensioning cable which is inserted through said hollow slat shaft and the ends of which are fixed to the respective beams.

Using such a tensioning cable, it is possible to keep the beams in place in a simple manner counter to the bulging caused by the weight and bending of the slats.

In this case, the term "cable" should not be interpreted in a limiting manner. For example, a cable can also be understood to mean a rope or a chain, etc.

Such a tensioning cable may be made, for example, from stainless steel or from plastic.

Such a tensioning cable is fixed to the beams in such a way that said hollow slat shaft and thus also the corresponding slat is rotatable around said tensioning cable.

The hollow slat shaft may assume an open, concave shape or a closed, concave shape. It will typically be designed to be cylindrically hollow, but may also be designed, for example, to have a substantially C-shaped cross section, with the C shape delimiting an open cavity of the slat shaft.

This tensioning cable is preferably arranged centrally in the slat roof in order to thus be able to prevent the bulging of the beams in the most effective way possible.

A slat of such a slat roof may be rotatably fixed to the beams using one single slat shaft, with this slat shaft extending over the length of this slat and the ends of which being rotatably mounted in the beams. However, each end of such a slat may also be provided with a slat shaft, with the opposite end of these slat shafts being rotatably mounted in the beams. This is typically the case where the slat shafts are arranged horizontally, for the sake of simplicity, in order to aid rotation, while the slat is arranged at an angle in order to aid drainage. When the tensioning cable is then inserted through the hollow slat shaft of such a shaft having two slat shafts, both slat shafts are preferably hollow and the tensioning cable is preferably inserted through both slat shafts. The slat itself is therefore preferably hollow between the two slat shafts in order to be able to integrate the tensioning cable into the slat shafts and the slat in an aesthetic manner.

A preferred embodiment of a slat roof according to the present invention comprises tensioning means, for tightening said tensioning cable, by means of which one of the ends of said tensioning cable is fixed to the respective beam.

Using such tensioning means, it is possible to tighten such a tensioning cable on site in a simple manner when installing the slat roof. In this way, it is also easily possible to adapt the tensioning of said tensioning cable to changing preconditions. If, for example, a slat roof is of a modular design and has glass slats of a more or less greater weight which are held between aluminium slats of a lesser weight, it is still possible to play in a localized manner with the placement of the slats in the slat roof, with it then being possible to provide the necessary tension to counteract bulging of the beams.

In a simple embodiment, said tensioning means comprise a tensioning shaft arranged so as to be rotatable in one direction of rotation with respect to the respective beam, and blocking means for blocking the rotation of said tensioning shaft in the opposite direction, wherein the respective end of the tensioning cable is fixed to said tensioning shaft.

By rotating the tensioning shaft it is thus possible to wind up the tensioning cable on said tensioning shaft. The blocking means ensure that the tensioning cable does not unwind again.

In a specific embodiment, the blocking means may comprise a gear wheel which is provided on the tensioning shaft and a shaft locking element for locking the tensioning shaft, which is arranged so as to be displaceable between a first position in which said shaft locking element engages with a toothing of the gear wheel and a second position in which said shaft locking element remains outside said toothing.

In this case, a gear wheel is understood to mean a wheel or a cylindrical piece, the shell of which is provided with a toothing. This term is therefore also understood to mean a toothed disc.

Said gear wheel may advantageously extend as a flange with respect to the tensioning shaft. However, said gear wheel could also be designed as a toothing on the periphery of the tensioning shaft.

The teeth of said gear wheel are preferably asymmetrical, in order to be able to achieve together with the shaft locking element the maximum level of locking counter to the direction of rotation and in order to impede the rotation of the tensioning shaft as little as possible in the direction of the rotation. The flanks of these teeth which provide the necessary locking together with the shaft locking element preferably extend substantially at right angles to the tensioning shaft. The other flanks of these teeth are preferably curved and preferably extend in a spiral with respect to the tensioning shaft.

In such an embodiment having a gear wheel and a shaft locking element, a returning force preferably forces the shaft locking element towards its first position and, during rotation of the tensioning shaft in the direction of rotation by an adjacent tooth of the toothing of the gear wheel with which it engages, the shaft locking element is moved towards its second position in order, with the next toothing, to be forced towards its first position under the influence of the returning force and to engage with said next toothing.

On rotation of the tensioning shaft, this adjacent tooth exerts such a force on the shaft locking element that the shaft locking element is moved towards its second position counter to the returning force.

The returning force of such tensioning means may assume different forms, such as, for example, a spring force and/or the force of gravity, etc.

Said tensioning means preferably comprise a spring, the spring force of which acts on the shaft locking element as a returning force.

In an alternative embodiment, the shaft locking element itself may for example be configured as a resilient element.

In a described embodiment having a gear wheel and a shaft locking element, the shaft locking element is preferably rotatably arranged in order to be provided so as to be displaceable between its first position and its second position.

By providing the shaft locking element so as to be rotatable, it is possible to design the tensioning means to be more compact. Installation space for these tensioning means may then be chosen more specifically mainly on account of the dimensions of the respective beam and any environmental factors and does not have to be determined by the shaft locking element.

Alternatively, the shaft locking element may, for example, also be provided so as to be linearly displaceable. However, in most cases, more installation space will have to be provided for this purpose.

More specifically, a rotatably arranged shaft locking element may be arranged so as to be rotatable about a rotation shaft and is guided by means of a guide shaft in a limiting guide slot which limits the rotational movement between the first position of the shaft locking element and the second position of the shaft locking element.

In such an embodiment, the tensioning means preferably comprise a wire spring as spring, which is clamped between the rotation shaft and the guide shaft in such a way that the spring force of this wire spring forces the shaft locking element towards its first position. In this way, an embodiment of a shaft locking element which is simple to produce is achieved.

In order to ensure in a simple manner that the respective slat shaft of a slat roof according to the present invention having a said tensioning shaft is and continues to be rotatable about the tensioning cable accommodated therein, said slat roof may advantageously comprise a guide element which is arranged between the respective end of the slat shaft and the tensioning shaft in order to guide the tensioning cable. Such a guide element makes it possible to ensure in a simple manner that the tensioning cable always leaves the rotation of the slat shaft unimpeded, regardless of the extent to which said tensioning cable has been wound up on the tensioning shaft.

Such a guide element is preferably designed as a guide wheel, so that it impedes the winding up of the tensioning cable on the tensioning shaft as little as possible.

A slat roof according to an embodiment of the present invention having said tensioning means preferably comprises a cable locking element which is fixed at the opposite end of the tensioning cable to the end to which the tensioning means are fixed, in order to lock said tensioning cable with respect to the respective beam. Using such a cable locking element, it is possible to mount such a tensioning cable in a simple manner.

Objects of the present invention are also achieved by providing a method for adapting a slat roof comprising beams, a plurality of slats arranged parallel to one another therebetween and slat shafts by means of which the slats are rotatably fixed to the respective beams, wherein a tensioning cable is inserted through a slat shaft and the ends of the tensioning cable are fixed to the respective beams.

Such a method also allows the stated problem to be solved in a simple manner and using simple means in slat roofs which have already been installed.

In this case, a slat shaft which is arranged in the centre of the slat roof is preferably chosen as the slat shaft. If the corresponding slat is fixed to the beams with two respective slat shafts, then the tensioning cable is preferably inserted through both of these slat shafts.

In a more specific method according to the invention, the slat roof comprises a solid slat shaft which is replaced by a hollow slat shaft, wherein the tensioning cable is inserted through this hollow slat shaft in order to be inserted through a slat shaft as indicated and fixed by its ends to the respective beams.

It is also possible in this case to replace the entire slat, together with the slat shaft or the slat shafts by means of which this is accommodated in the slat roof.

In a method according to the present invention, tensioning means are preferably also provided and mounted, with the tensioning cable then being tensioned with the aid of these tensioning means.

BRIEF DESCRIPTION OF THE DRAWINGS

The present invention will now be explained in more detail by means of the following detailed description of some preferred embodiments of a slat roof according to the present invention and a method for adapting a slat roof. The sole aim of this description is to give illustrative examples and to indicate further advantages and features of the present invention, and can therefore by no means be interpreted as a limitation of the area of application of the invention or of the patent rights defined in the claims.

Reference numerals are used in this detailed description to refer to the attached drawings, in which.

DETAILED DESCRIPTION

Figure 1:
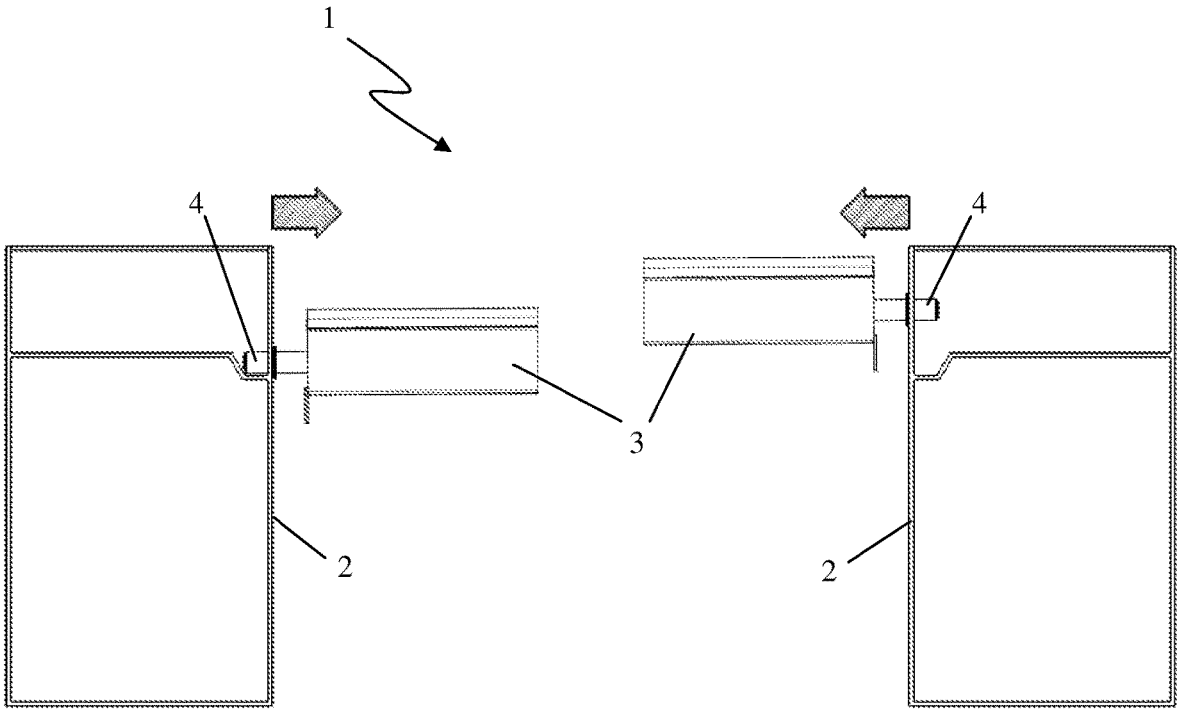
FIG. 1 diagrammatically shows in a slat roof in cross section how the beams in a slat roof according to the invention are centrally pulled towards one another at the location of a slat with a tensioning cable under prestress.

FIG. 1 illustrates how a slat (3) of a slat roof (1) according to an embodiment of the present invention is rotatably fixed to two side beams (2) with the aid of slat shafts (4). In such a slat roof (1), a plurality of slats (3) are arranged parallel to one another and are rotatable about respective shafts (4). For this purpose, these shafts are in each case held in openings (16) in the beams (2) (see FIGS. 5, 7, 11 and 13). By rotating the slats (3), they can be displaced between an open position and a closed position. In the open position, there is an intermediate space between the slats (3) through which, for example, air can flow into the space below or can leave the space below. In the closed position, the slats (3) form a closed shelter by means of which the space below can be protected from, for example, wind and/or precipitation.

In order to aid the drainage of precipitation, the slats (3) are arranged running obliquely towards one of the two beams (2).

The beams (2) may, for example, be made from aluminium, plastic, wood, etc. The slats (3) may, for example, also be made from profiles of aluminium or plastic and may optionally be provided with filler elements of, for example, polycarbonate, glass or wood, etc.

Under the weight and the bending of the slats (3), the beams (2) begin to bulge in the plane of the slats. In order to prevent this, the beams (2) according to the invention are pulled towards one another counter to this bulging with the aid of a tensioning cable (5). The force exerted on the beams (2) in this case by such a tensioning cable (5) is diagrammatically illustrated in FIG. 1 with arrows.

The tensioning cable (5) may, for example, be made from stainless steel or plastic, etc.

In FIGS. 4-7 and 10-12, said tensioning cable (5) is already present in the slat roof (1). Said tensioning cable (5) may also be integrated into an existing slat roof (1) in a simple manner.

In order to be able to fix the tensioning cable (5), the slat shafts (4) of a slat (3) which is arranged in the centre of the slat roof (1) are preferably hollow. The slat (3) itself is also preferably hollow between these slat shafts (4). In an existing slat roof (1) in which the slat shafts (4) are solid, at least one slat shaft (4) is preferably replaced by a hollow slat shaft (4). The corresponding slat (3) is optionally also replaced by a hollow slat (3).

The tensioning cable (5) is then inserted through the cavity of the one or more hollow slat shafts (4) and the optional cavity of the slat (3). At one end, this tensioning cable (5) is preferably locked in the respective beam (2) by means of a cable locking element (14) and a cable locking block (15), as illustrated in FIGS. 2 to 7. At its other end, this tensioning cable (5) is preferably fixed in a tightenable manner in the respective beam (2) by means of tensioning means, as illustrated in FIGS. 8 to 13.

Figure 2:
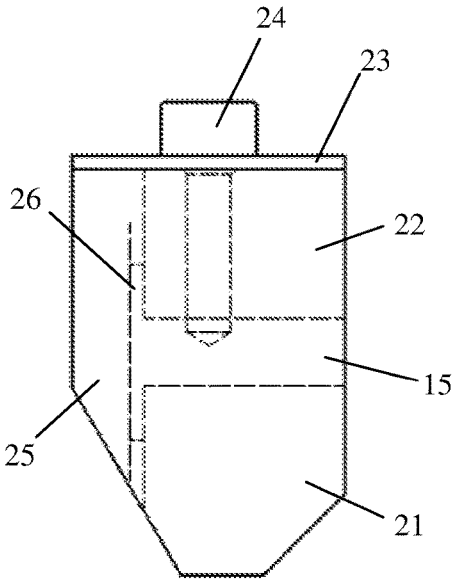
FIG. 2 shows a locking block in side view for locking a cable locking element therein for locking a tensioning cable in a beam of a slat roof according to the present invention.
Figure 3:
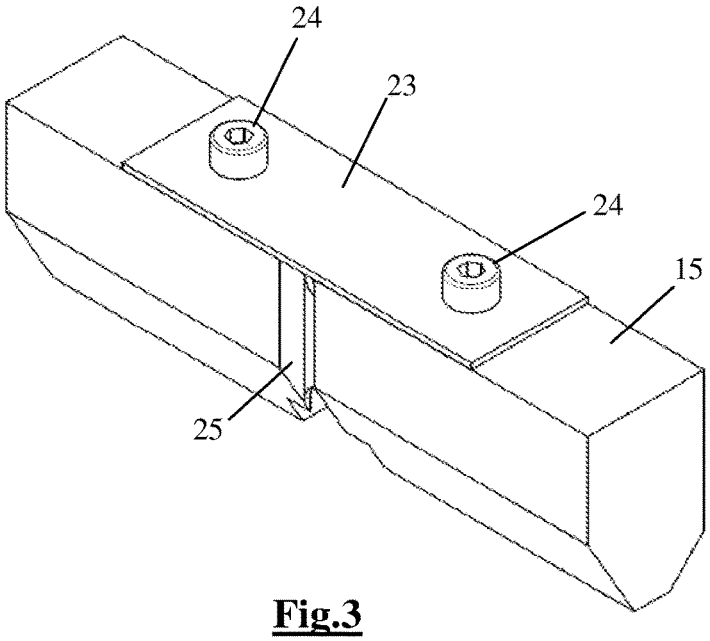
FIG. 3 shows the locking block from FIG. 2 in perspective.
Figure 4:
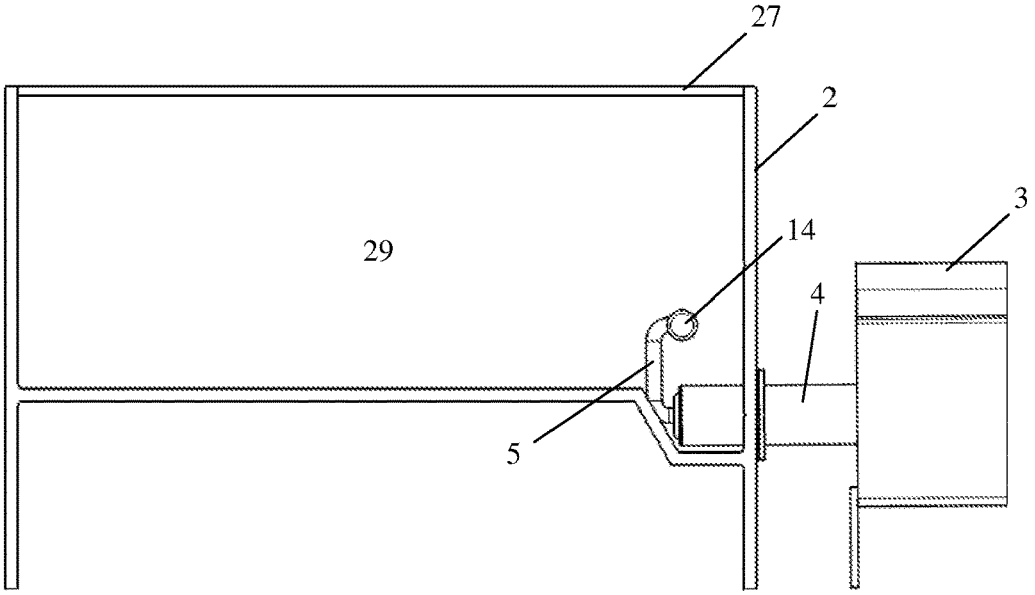
FIG. 4 shows a cross section of a part of a beam and a slat fixed thereto of a slat roof according to the invention, with a tensioning cable through the slat shaft, with a locking element at the end of the tensioning cable, in order to be locked in the locking block from FIG. 2.
Figure 5:
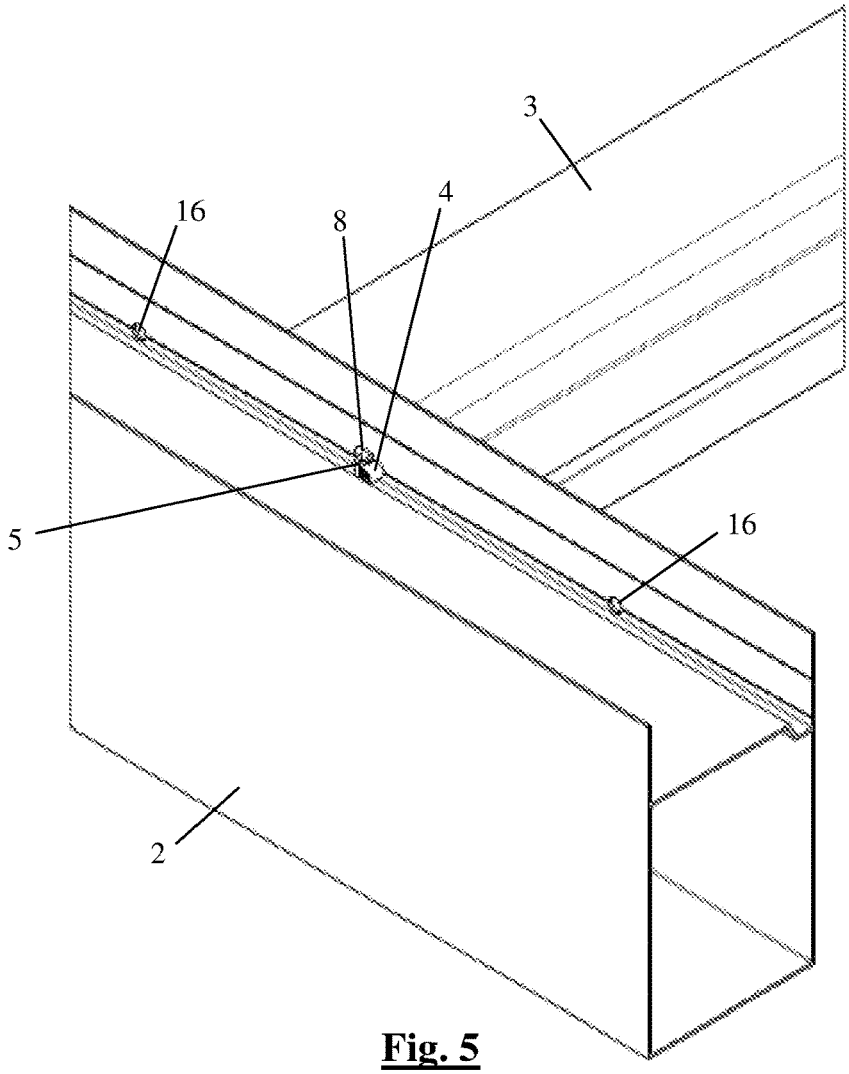
FIG. 5 shows the part of the slat roof from FIG. 4 in perspective, without the top profile of the beam.
Figure 6:
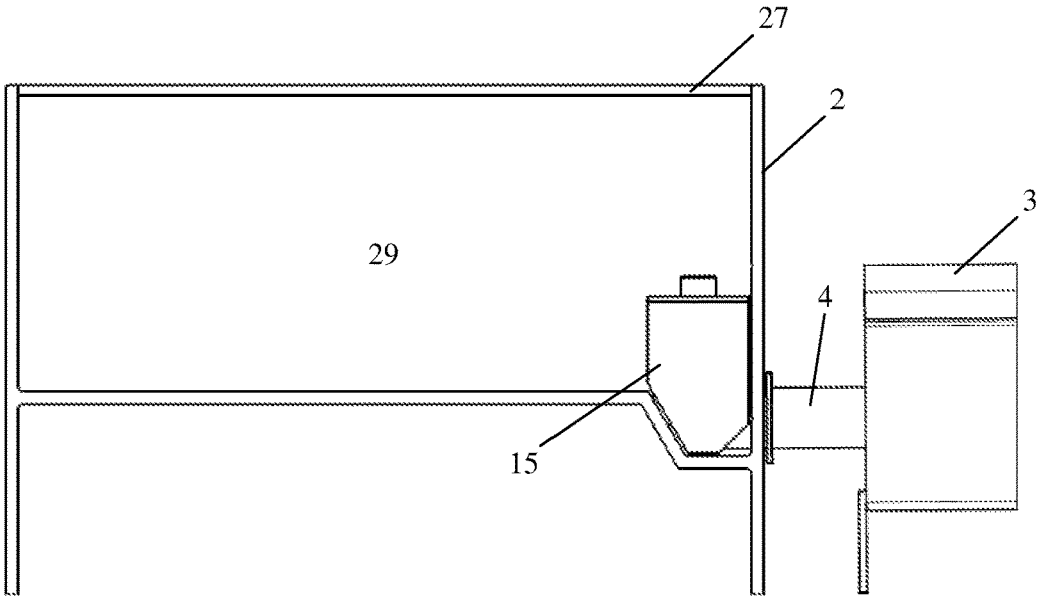
FIG. 6 shows the part of the slat roof from FIG. 4 in cross section, with the locking block from FIG. 2.
Figure 7:
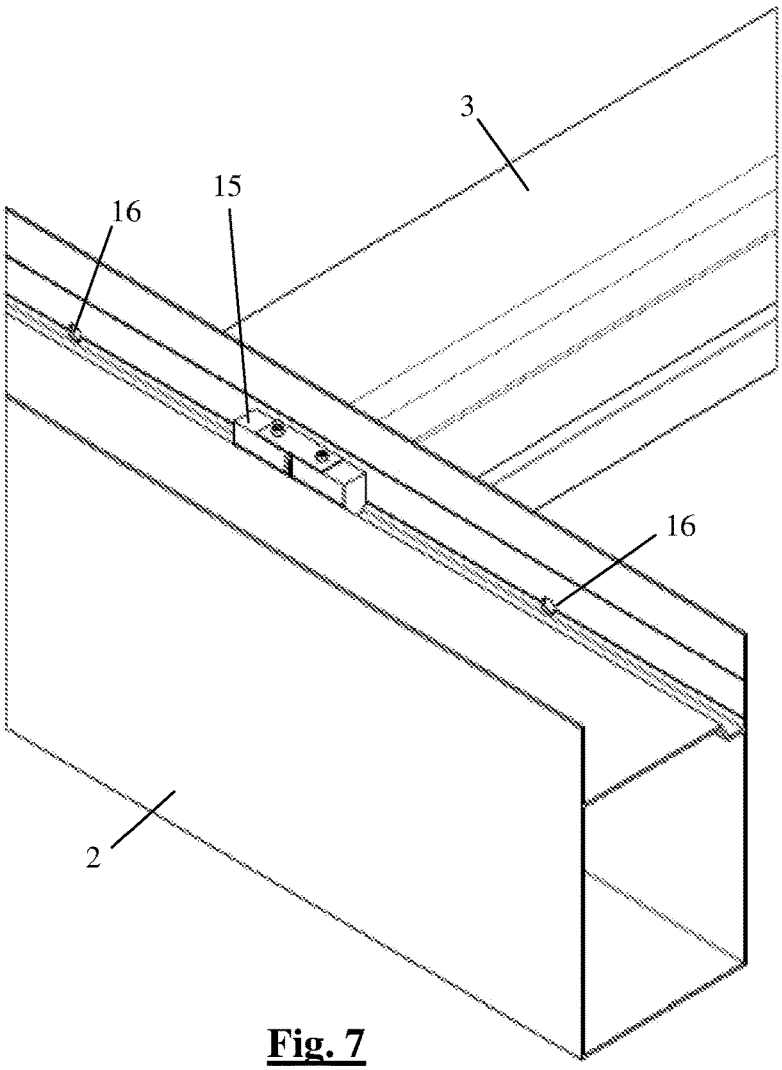
FIG. 7 shows the part of the slat roof from FIG. 4 in perspective, without the top profile of the beam and with the locking block from FIG. 2.

FIGS. 2 and 3 illustrate a locking block (15) by means of which one end of the tensioning cable (5) is locked in the respective beam (2), as illustrated in FIGS. 4 to 7. As can be seen in FIGS. 4 and 5, this end of the tensioning cable (5) itself is for this purpose provided with a cable locking element (14). On the bottom of the locking block (15) there is a cavity (21) into which the corresponding slat shaft (4) can be fitted. As can be seen in FIGS. 4 and 5, the tensioning cable (5) is then curved upwards in order to fit into the cavity (25) at the rear of the locking block (15) and once again curved towards the slat (3), with it being possible to fit the cable locking element (14) into a cavity (22) at the top of the locking block (15), with this being locked behind the locking edge (26). In order to hold the cable locking element (14) in the locking block (15), with the release thereof being prevented, a closing plate (23) is screwed to the top of the locking block (15) with the aid of screws (24). As illustrated in FIGS. 5 and 7, the locking block (15) and the relevant end of the tensioning cable (5) can be fixed in the interior (29) of the beam (2) when the top profile (27) of this beam (2) is removed. This top profile (27) can then be attached in order to close off the interior of the beam (2). In alternative, but less preferred embodiments, the locking block (15) and the relevant end of the tensioning cable (5) could also be fixed to an outer side of such a beam (2).

Figure 8:
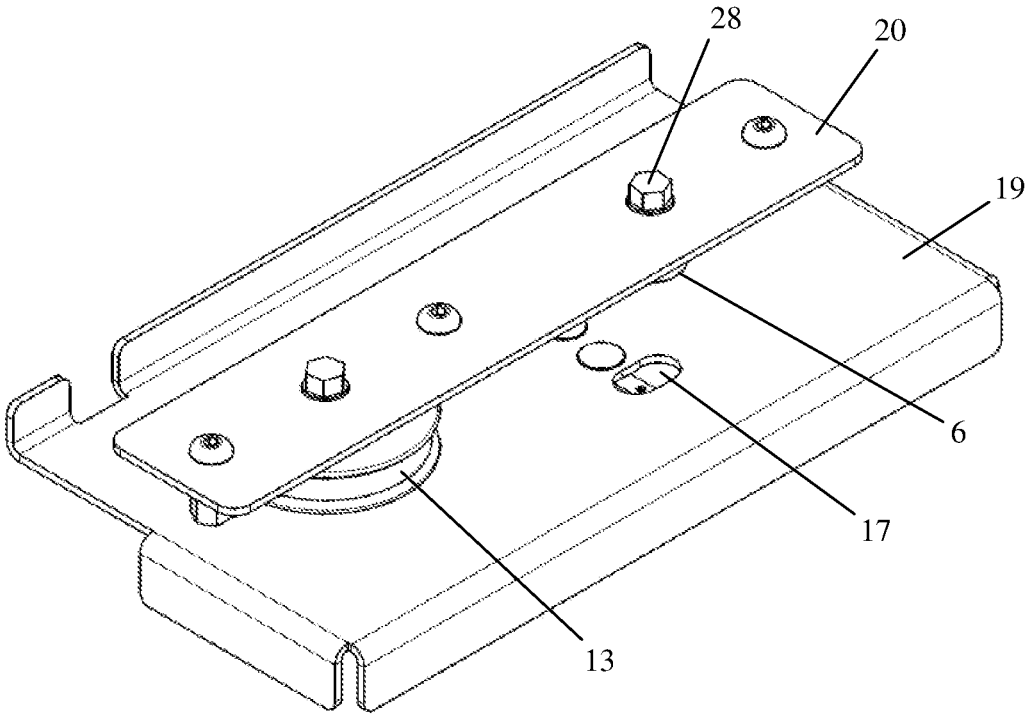
FIG. 8 shows tensioning means of a slat roof according to the present invention in perspective as viewed from above.
Figure 9:
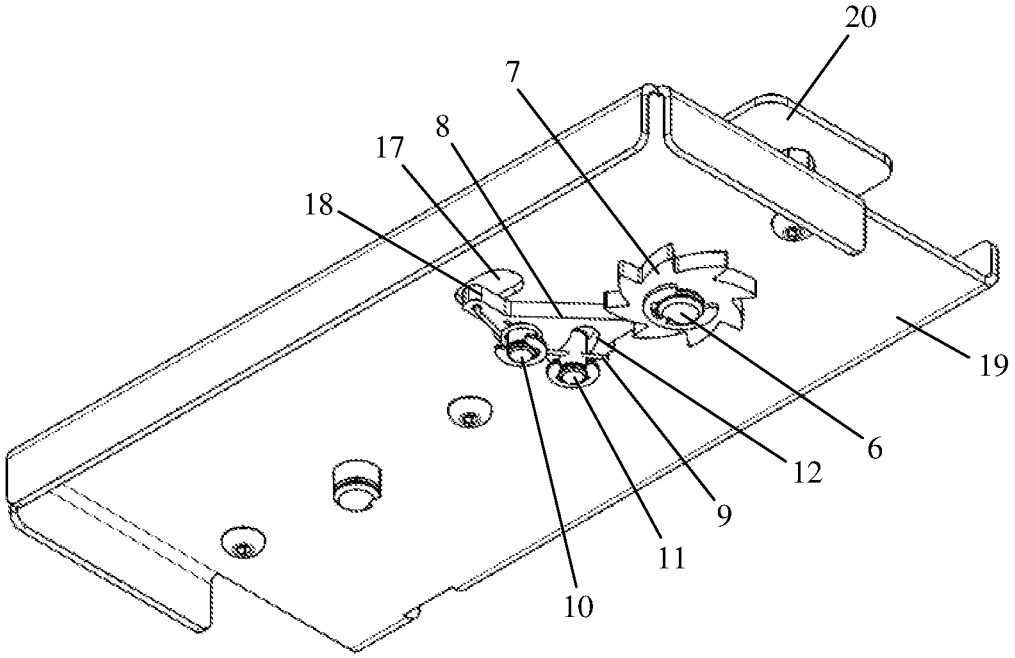
FIG. 9 shows the tensioning means from FIG. 8 in perspective as seen from below.
Figure 10:
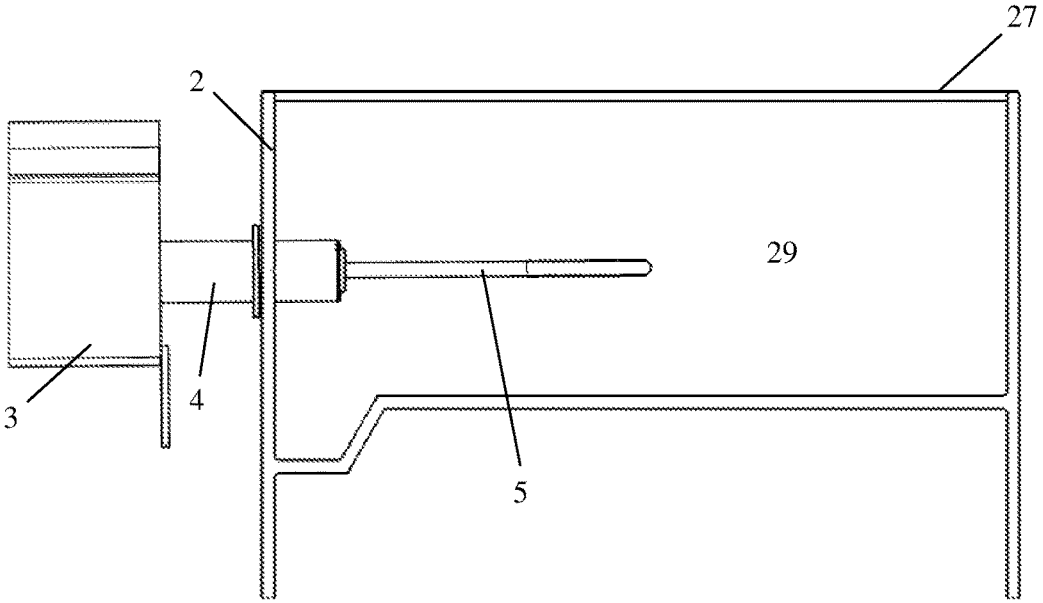
FIG. 10 shows a cross section of a part of a beam and a slat fixed thereto of a slat roof according to the present invention, with a tensioning cable through the slat shaft, which is provided in order to be clamped at this end using the tensioning means from FIG. 8.

FIGS. 8 and 9 illustrate tensioning means by means of which the end of the tensioning cable (5) opposite the end with the locking element (14) is fixable in the respective beam (2) in a tightenable manner, as illustrated in FIGS. 10 to 13.

Said tensioning means are fitted into the beam (2) with the aid of a mounting plate (19). On the top of said mounting plate (19), the tensioning cable (5) is guided around a guide wheel (13) and fed to a tensioning shaft (6) to which the end of the tensioning cable (5) is fixed. The guide wheel (13) and the tensioning shaft (6) are held between said mounting plate (19) and a holding plate (20) so that the tensioning cable (5) is kept in place with a high degree of certainty. The tensioning shaft (6) is rotatably arranged in order for the tensioning cable (5) to be able to wind up on it. On the bottom of the fixing plate (19), a shaft locking element (8) engages with a gear wheel (7) which is securely fixed to the tensioning shaft (6) in order to prevent the tensioning cable (5) from inadvertently unwinding from the tensioning shaft (6) again. Said shaft locking element (8) and said gear wheel (7) are arranged on the other side of the fixing plate (19) than the tensioning shaft (6) itself, so that they do not impede the movement of the tensioning cable (5).

The shaft locking element (8) is arranged so as to be rotatable about a rotation shaft (10). The rotational movement of the shaft locking element (8) is guided by means of a guide shaft (11), which is mounted on the mounting plate (19), in a limiting guide slot (12) in the shaft locking element (8), so that the rotational movement is limited between a first position and a second position. The guide slot (12) could alternatively also be provided in the mounting plate (19) if the guide shaft (11) is provided on the shaft locking element (8). In the first position, the shaft locking element (8) engages with a toothing of the gear wheel (7). In the second position, the shaft locking element (8) is moved outside of this toothing. A wire spring (9) is clamped between the rotation shaft (10) and the guide shaft (11) in such a way that the spring force of this wire spring (9) forces the shaft locking element (8) towards its first position.

Figure 11:
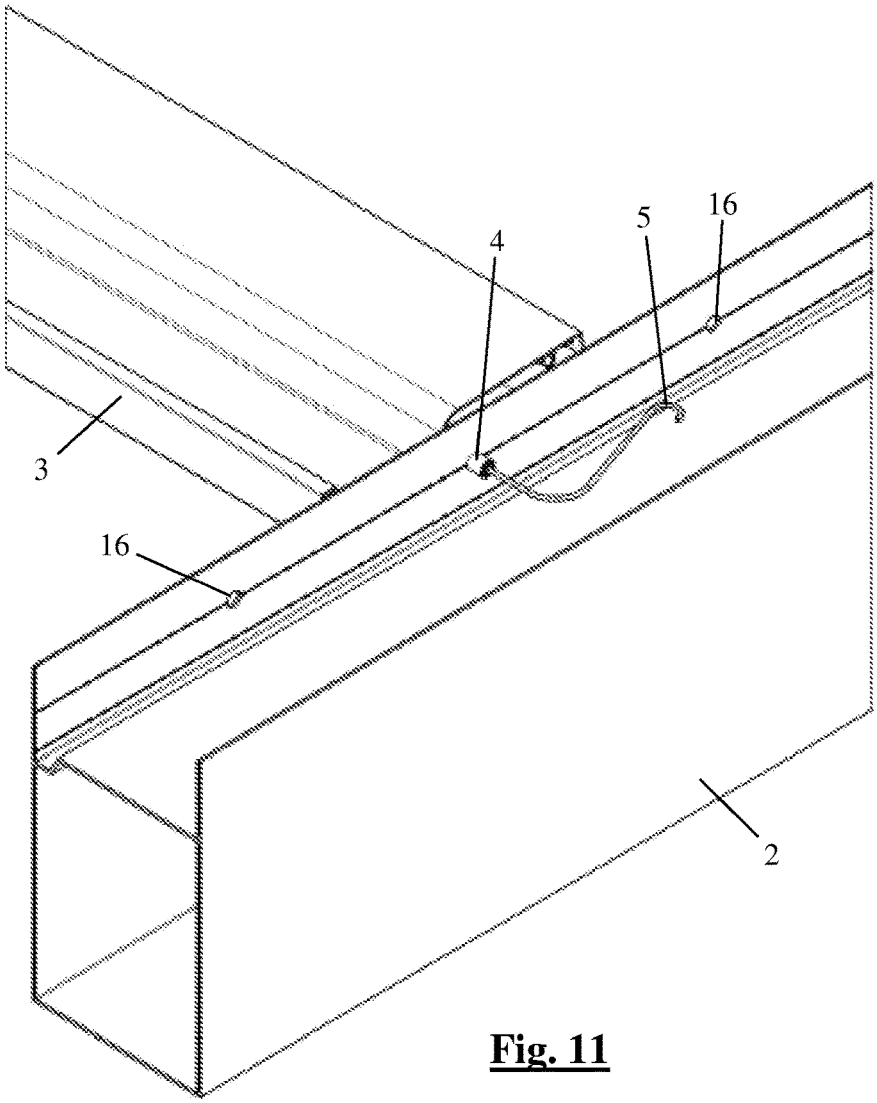
FIG. 11 shows the part of the slat roof from FIG. 10 in perspective, without the top profile of the beam.
Figure 12:
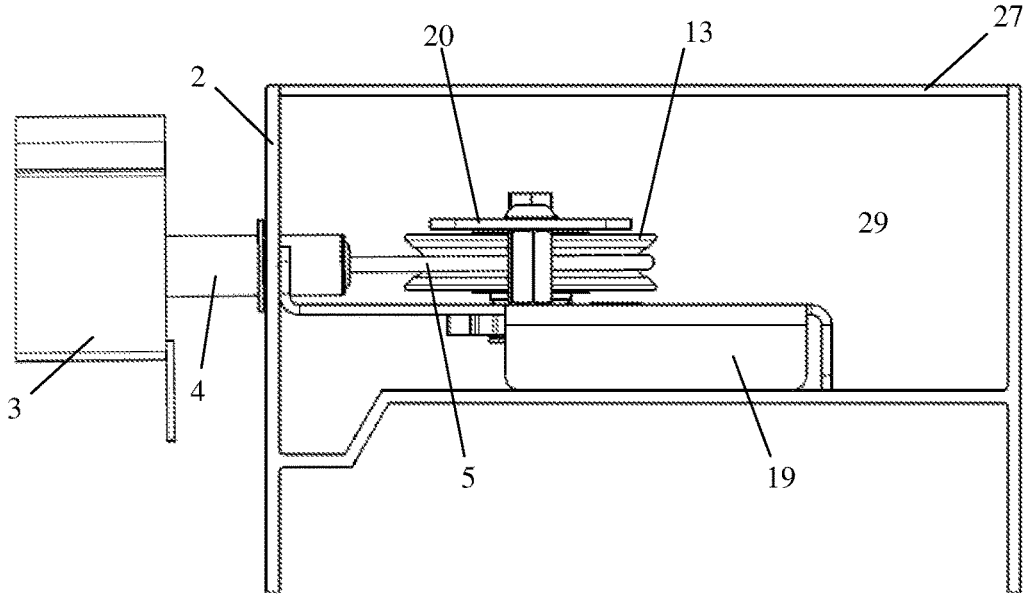
FIG. 12 shows the part of the slat roof from FIG. 10 in cross section, with the tensioning means from FIG. 8.
Figure 13:
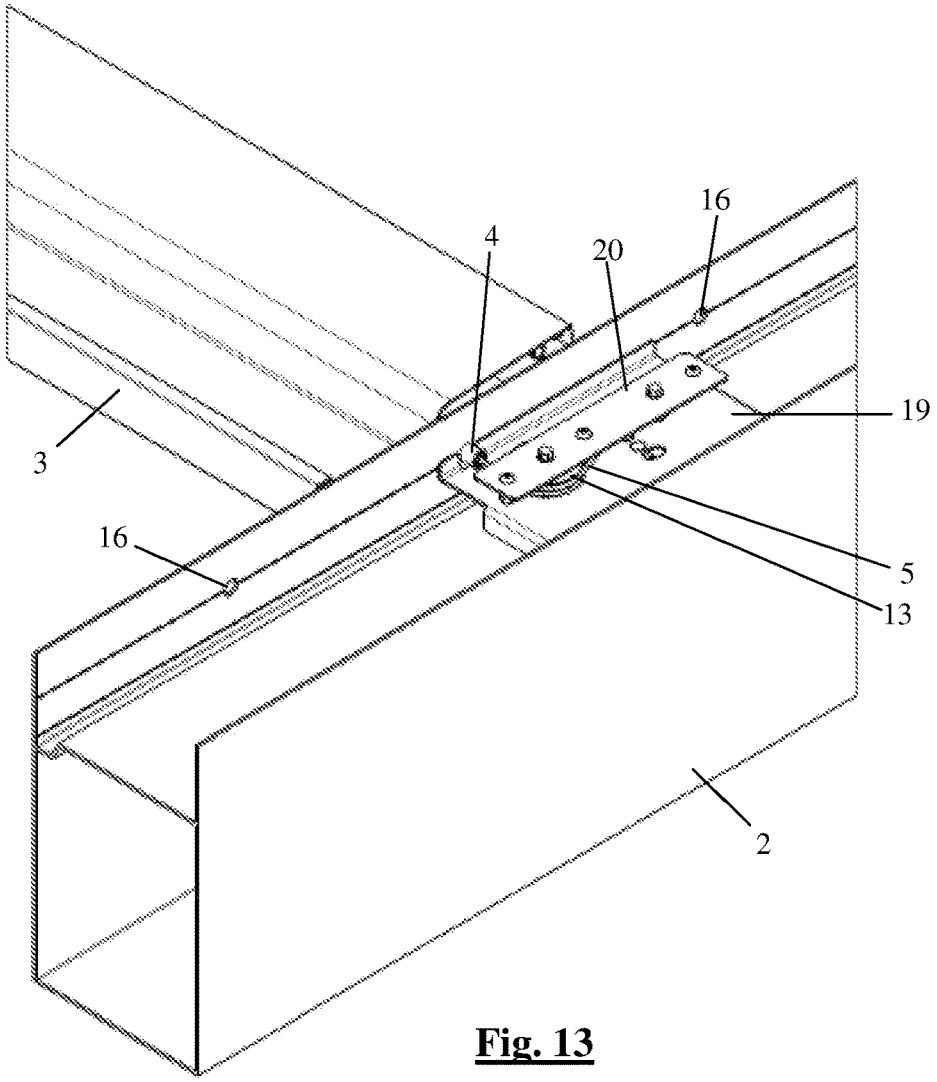
FIG. 13 shows the part of the slat roof from FIG. 10 in perspective, without the top profile of the beam and with the tensioning means from FIG. 8.

As illustrated in FIGS. 11 and 13, the tensioning means may be fixed in the interior (29) of the beam (2) when the top profile (27) of this beam (2) has been removed. This top profile (27) can then be attached in order to close off the interior of the beam (2). In alternative, but less preferred embodiments the tensioning means could also be fixed to an outer side of such a beam (2).

When the top profile (27) of the beam (2) has been removed, the bolt head (28) on top of the tensioning shaft (6) can be engaged with a hand tool in order to rotate the tensioning shaft (6). In this case, the tensioning shaft (6) can only be rotated in one direction. If, in the illustrated embodiment, an attempt is made to rotate the bolt head (28) in the anticlockwise direction, this will be prevented by the shaft locking element (8) abutting the flank of the adjacent tooth of the toothing of the gear wheel (7), which extends substantially at right angles to the tensioning shaft (6). As a result, the gear wheel (7) and thus also the tensioning shaft (6) and the bolt head (28) are locked and rotation is prevented in this direction. However, if the bolt head (28) is rotated in the clockwise direction at a certain force which exceeds the spring force of the wire spring (9) and the tensioning force of the tensioning cable (5), the flank, which is curved in a spiral, of the toothing of the gear wheel (7) with which the locking element (8) engages will rotate the locking element (8) counter to the spring force. In this way, the locking element (8) can be moved into its second position in order to be forced, with the next toothing, back towards its first position under the influence of the spring force in order to engage with the next toothing. In this way, the tensioning cable (5) can be wound up on the tensioning cable (6) in a stepped manner and thus tightened in order to pull the beams (2) towards one another under the necessary prestress.

If the tensioning cable (5) were to be overtightened in this way or if it were desired to remove the relevant slat (3), it is possible to engage with an engagement element (18) of the shaft locking element (8) through an opening (17) in the mounting plate (19) in order to be able to manually move the shaft locking element (8) into its second position and to be at least partially able to unwind the tensioning cable (5) from the tensioning shaft (6).

The invention claimed is:

1. A slat roof, comprising:

beams, a plurality of slats arranged parallel to one another and positioned between the beams, and slat shafts connecting each of the slats to two of the beams, wherein at least one slat shaft is hollow and the slat roof comprises at least one corresponding tensioning cable which is inserted through said hollow slat shaft and has ends fixed to the beams, and wherein both said hollow slat shaft and a slat connected to said hollow slat shaft are rotatable around the at least one corresponding tensioning cable.

2. The slat roof according to claim 1, characterized in that said slat roof comprises a tensioner, for tightening said tensioning cable, by means of which one of the ends of said tensioning cable is fixed to one of the respective beams.

3. The slat roof according to claim 2, characterized in that said tensioner comprises a tensioning shaft arranged so as to be rotatable in one direction of rotation with respect to the one of the respective beams, and comprises a blocker for blocking the rotation of said tensioning shaft in the opposite direction, wherein the respective end of the tensioning cable is fixed to said tensioning shaft.

4. The slat roof according to claim 2, characterized in that said slat roof comprises a cable locking element which is fixed at an end of the tensioning cable that is opposite to the end to which the tensioner is fixed, in order to lock said tensioning cable with respect to the one of the respective beams.

5. The slat roof according to claim 3, characterized in that the blocker comprises a gear wheel which is provided on the tensioning shaft and comprises a shaft locking element for locking the tensioning shaft, which is arranged so as to be displaceable between a first position in which said shaft locking element engages with a toothing of the gear wheel and a second position in which said shaft locking element remains outside said toothing.

6. The slat roof according to claim 3, characterized in that said slat roof comprises a guide element which is arranged between the respective end of the slat shaft and the tensioning shaft in order to guide the tensioning cable.

7. The slat roof according to claim 6, characterized in that the guide element is designed as a guide wheel.

8. The slat roof according to claim 5, characterized in that a returning force forces the shaft locking element towards its first position and in that, during rotation of the tensioning shaft in the direction of rotation by an adjacent tooth of the toothing of the gear wheel with which it engages, the shaft locking element is moved towards its second position in order, with the next toothing, to be forced towards its first position under the influence of the returning force and to engage with said next toothing.

9. The slat roof according to claim 5, characterized in that the shaft locking element is rotatably arranged in order to be provided so as to be displaceable between its first position and its second position.

10. The slat roof according to claim 9, characterized in that the shaft locking element is arranged so as to be rotatable about a rotation shaft and is guided by means of a guide shaft in a limiting guide slot which limits the rotational movement between the first position of the shaft locking element and the second position of the shaft locking element.

11. The slat roof according to claim 8, characterized in that the tensioner comprises a spring, the spring force of which acts on the shaft locking element as a returning force.

12. The slat roof according to claim 11, characterized in that the tensioner comprises a wire spring as the spring, which is clamped between the rotation shaft and the guide shaft in such a way that the spring force of this wire spring forces the shaft locking element towards its first position.

13. A method for modifying a slat roof comprising beams, a plurality of slats arranged parallel to one another and positioned between the beams, and slat shafts connecting each of the slats to two of the beams, comprising:

inserting a tensioning cable through a slat shaft; and fixing each end of the tensioning cable to the respective beam, wherein both said slat shaft and a slat connected to said slat shaft are rotatable around the tensioning cable.

14. The method according to claim 13, further comprising replacing a solid slat shaft with a hollow slat shaft and inserting the tensioning cable through the hollow slat shaft and fixing the tensioning cable by each end to the respective beam.

* * * * *